US008727115B2

(12) United States Patent
Liao

(10) Patent No.: US 8,727,115 B2
(45) Date of Patent: May 20, 2014

(54) GOLF-BALL RETAINING PLATE

(76) Inventor: Yun-Hsian Liao, Zhudong Township, Hsinchu County (TW)

( * ) Notice: Subject to any disclaimer, the term of this patent is extended or adjusted under 35 U.S.C. 154(b) by 8 days.

(21) Appl. No.: 13/589,177

(22) Filed: Aug. 20, 2012

(65) Prior Publication Data

US 2013/0175190 A1 Jul. 11, 2013

(30) Foreign Application Priority Data

Jan. 6, 2012 (TW) ..... 101200395 A

(51) Int. Cl.
*B65D 85/00* (2006.01)
*B65D 1/36* (2006.01)

(52) U.S. Cl.
USPC ..... 206/315.9; 206/562; 206/565

(58) Field of Classification Search
USPC ..... 206/315.9, 562–565; 211/14, 15
See application file for complete search history.

(56) References Cited

U.S. PATENT DOCUMENTS

| | | | | |
|---|---|---|---|---|
| 4,927,052 | A * | 5/1990 | Marthaler et al. | 206/315.9 |
| 6,193,120 | B1 * | 2/2001 | Chang | 206/315.9 |
| 6,755,912 | B2 * | 6/2004 | Brown et al. | 206/315.9 |
| 6,872,423 | B2 * | 3/2005 | Brown et al. | 206/315.9 |
| 8,388,091 | B2 * | 3/2013 | Matsui et al. | 347/16 |

* cited by examiner

*Primary Examiner* — Bryon Gehman
(74) *Attorney, Agent, or Firm* — Leong C. Lei

(57) ABSTRACT

A portable golf ball retaining plate includes a plate body provided with multiple grooves, wherein two opposite adjusting portions are arranged at upper side of each of the grooves, wherein the opposite adjusting portion at adjacent ones of the grooves are alternatingly arranged longitudinally and transversely. Thereby, the grooves can expand for receiving golf balls. When the golf ball is being retained in one of the grooves, the corresponding adjusting portions expand first and then contract such that the golf ball is retained. When the golf ball is being taken out, the corresponding adjusting portions first expand to the surrounding space and then contract to the original state.

7 Claims, 4 Drawing Sheets

GOLF-BALL RETAINING PLATE

BACKGROUND OF THE DISCLOSURE a) Field of the Disclosure

The invention relates to a portable retaining plate, and more particularly, to a portable golf-ball retaining plate for retaining multiple golf balls in order and reducing a probability of the golf balls dropping.

b) Brief Description of the Related Art

Generally, golf balls are only put into a bag, but not retained. Thus, the golf balls are easily damaged due to friction between them. Furthermore, when we play golf ball, small articles, like watches, rings, keys or mobile phones, could be put into the bag. This could lead the small articles to be broken. The golf balls probably drops all over the ground while the bag suddenly opens. Some portable golf-ball retaining plates do not provide enough space for retaining golf balls or do not have golf balls to be readily retained or taken. A way how golf balls can be efficiently retained is widely expected to be provided by golf players. Accordingly, the conventional portable retaining plates having the above problems are not good designs and are necessary to be improved.

The inventors had long experience in this field and straight did researches and tests, and finally a portable golf-ball retaining plate is developed to significantly improve the conventional disadvantages.

SUMMARY OF THE DISCLOSURE

In accordance with an objective of the present invention, storage capacity of golf balls can be increased and the amount of the golf balls can be specific.

In accordance with an objective of the present invention, golf balls can be retained in order and avoided from dropping.

In accordance with an objective of the present invention, the portable golf-ball retaining plate has a user to easily retain or take golf balls.

In order to achieve the above objectives, a portable golf-ball retaining plate includes a retaining plate provided with multiple grooves, wherein two opposite adjusting portions are arranged at an upper side of each of the grooves, wherein the opposite adjusting portions at adjacent ones of the grooves are altematingly arranged longitudinally and transversely.

In an embodiment, the retaining plate is made of a tough elastomer.

In an embodiment, one of the grooves has a greater width at the upper side thereof than that at a lower side thereof.

In an embodiment, the adjusting portions first expand and then contract when a golf ball is being retained or taken.

Accordingly, besides the portable golf-ball retaining plate has multiple golf balls to be retained in the grooves, the adjusting portions can adequately moves such that the golf balls do not easily drop when the golf balls are being retained or taken.

The accompanying drawings are included to provide a further understanding of the invention, and are incorporated as a part of this specification. The drawings illustrate embodiments of the invention and, together with the description, serve to explain the principles of the invention.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

Figure 1:
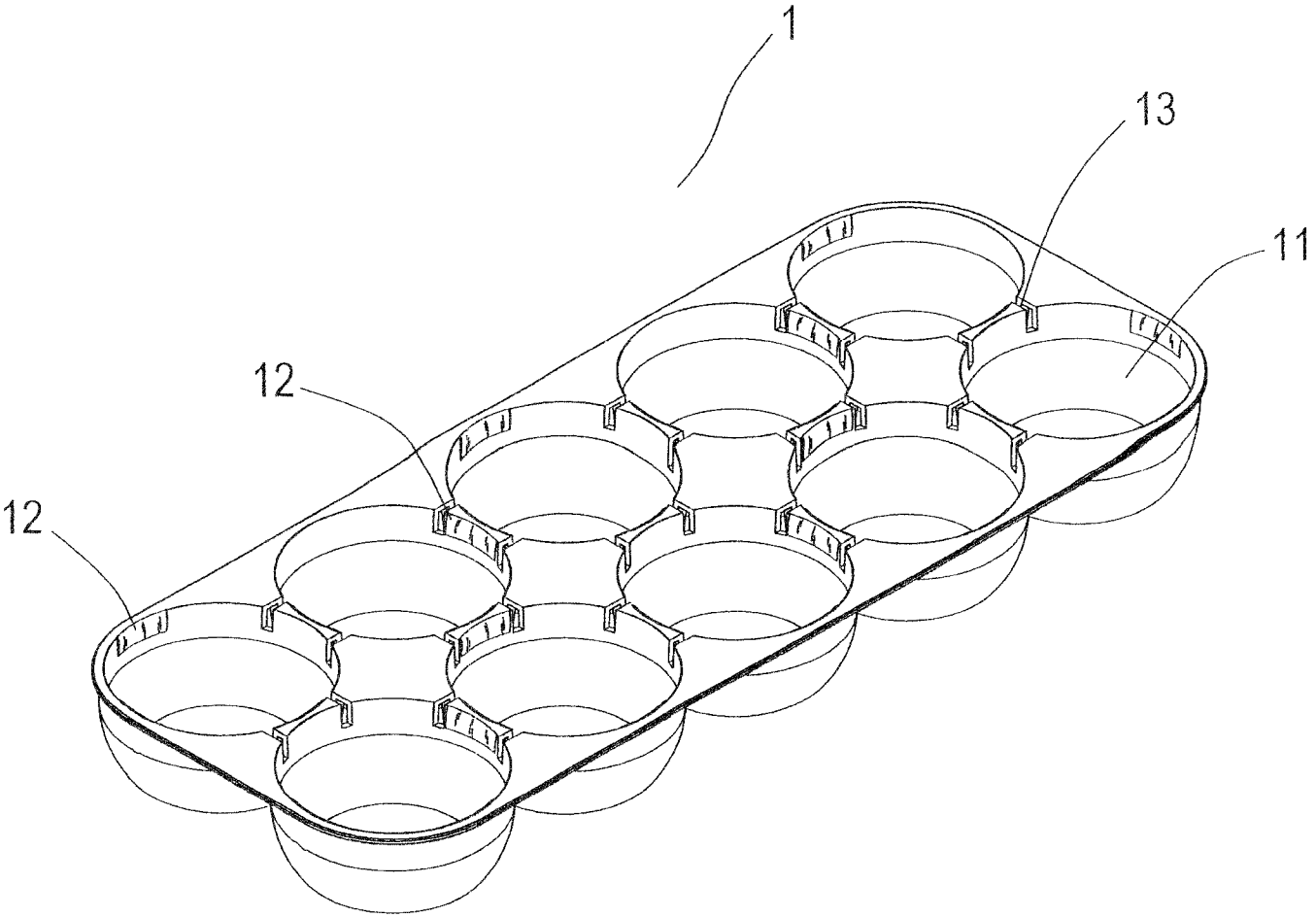
FIG. 1 is a three dimensional view in accordance with the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

Referring to FIG. 1, a portable golf-ball retaining plate includes a retaining plate 1 made of a tough elastomer, such as PP, wherein the retaining plate 1 is provided with multiple grooves 11, wherein two opposite adjusting portions 12 are arranged at an upper side of each of the grooves 11, wherein the opposite adjusting portions 12 at the adjacent grooves 11 are altematingly arranged longitudinally and transversely. The adjusting portions 12 are shaped like bumps. Connecting portions 13 arranged between the grooves 11 support the grooves 11 to bear stresses and deformations. In this case, no connecting portions are arranged at a periphery of the retaining plate 1 because no other golf balls are retained here and are led to repress the grooves 11.

Figure 2:
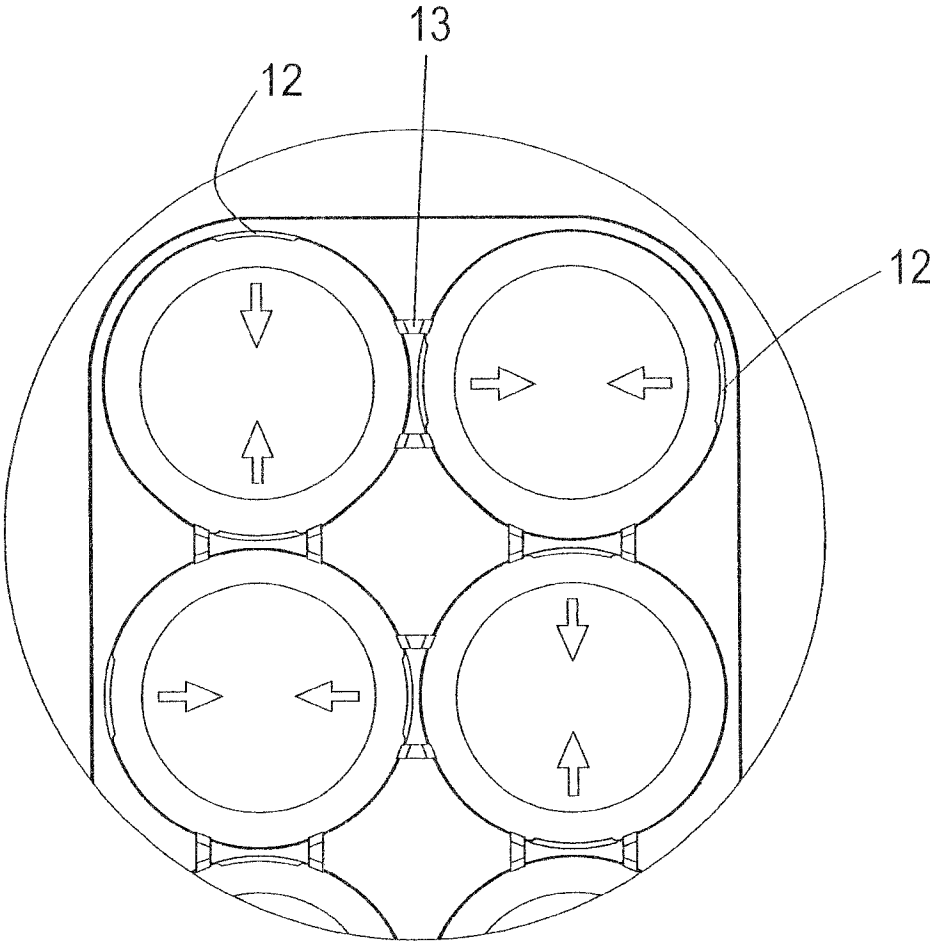
FIG. 2 is an enlarged partial view showing adjustment of adjacent grooves in accordance with the present invention.
Figure 3:
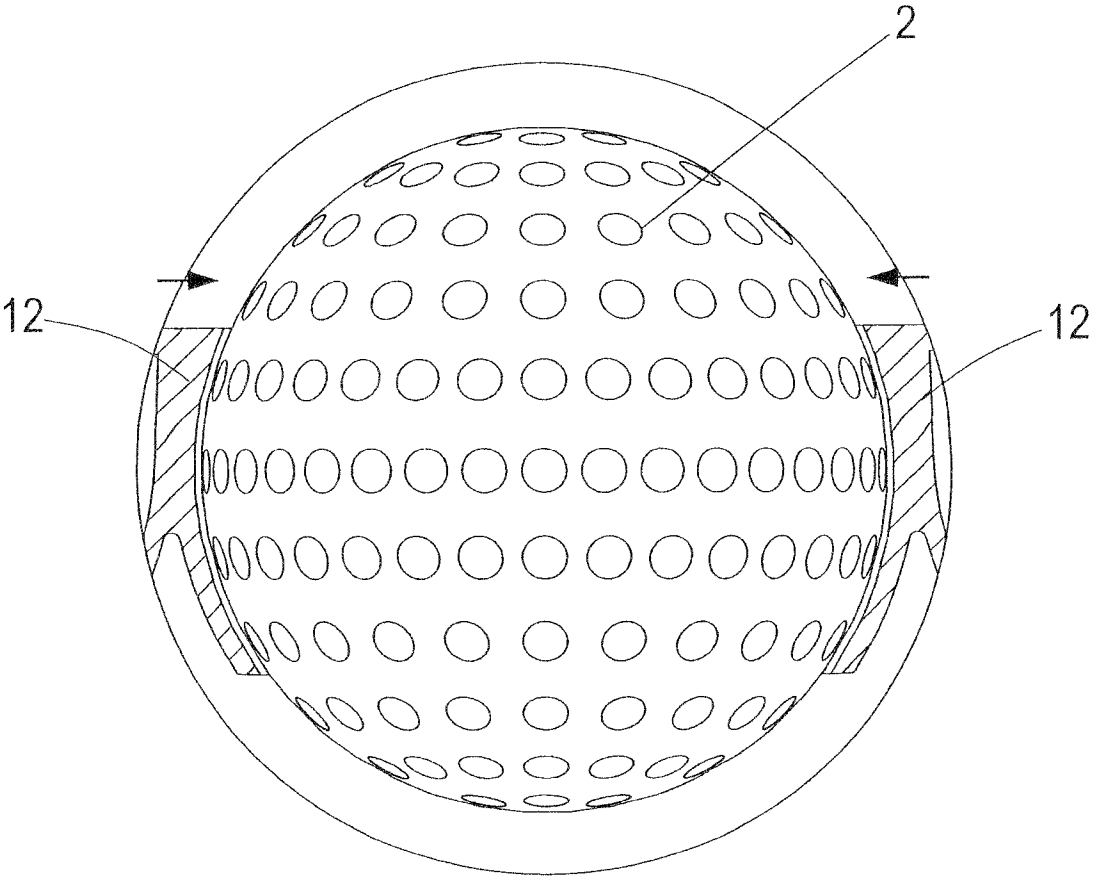
FIG. 3 is a schematic view of a golf ball retained completely in accordance with the present invention.

FIGS. 2 and 3 are cross sectional views in operation. Referring to FIGS. 2 and 3, when golf balls 2 are retained in the grooves 11, the adjusting portions 12 push the connecting portions 13 to expand to the surrounding space. When the golf balls 2 have centers arriving at the upper sides of the grooves 11, the connecting portions 13 expand ultimately. Next, the connecting portions 13 start to contract such that the golf balls 2 can be retained. In case that the adjusting portions 12 at adjacent two of the grooves 11 are aligned in the same line, two of the golf balls cannot pass through the adjacent two of the grooves 11 due to the thicknesses of the adjusting portions 12. Accordingly, the adjusting portions 12 at adjacent two of the grooves 11 are arranged longitudinally and transversely, respectively. The grooves 11 have diameters slightly greater than those of the golf balls 2 and thus the golf balls 2 still can roll without dropping. The golf balls 2 when being taken from the grooves 11 are pushed from hollow spaces at bottoms of the grooves 11. Thus, the adjusting portions 12 expand first and then the connecting portions 13 expand ultimately when the centers of the golf balls 2 arrive at the upper sides of the grooves 11. Next, the adjusting portions 12 contract to the original state. Only little force needs to be applied when the golf balls 2 are taken. Accordingly, injuries can be avoided and particularly the golf balls 2 can be easily taken by women with long fingernails.

Figure 4:
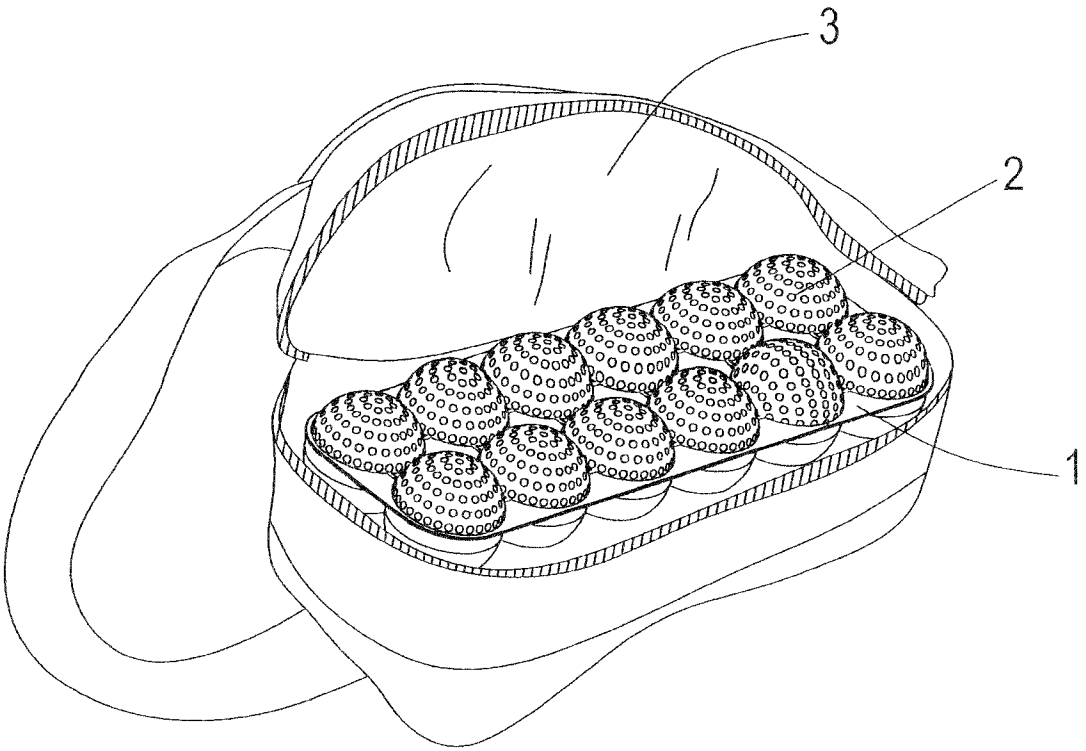
FIG. 4 is a schematic view in accordance with an embodiment of the present invention.

Referring to FIG. 4, multiple of the golf balls 2 can be retained in the retaining plate 1 and do not worry to drop or cause friction therebetween. Besides, when we play golf ball, small articles, like necklaces, watches or rings, could be put into a bag 3. The retained golf balls 2 do not lead the small articles to be broken. Further, in accordance with the present invention, the retaining plate 1 cannot be put into the bag 3, and the bag 3 can be used for other purposes.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A portable-golf ball retaining plate, comprising:

a plate body provided with multiple grooves, wherein two opposite adjusting portions are arranged at an upper side of each of the grooves, wherein the adjusting portions of one of two adjacent grooves are arranged in line in a first direction and the adjusting portions of the adjacent one of the two grooves are arranged in line in a second direction that is transverse to the first direction, wherein when a golf ball is being retained in one of the grooves, the adjusting portions of the one groove expand along a periphery of the golf ball and then contract such that the golf ball is retained in the one groove.

2. The portable golf ball retaining plate of claim 1, wherein the retaining plate comprises a tough elastomer.

3. The portable golf ball retaining plate of claim 2, wherein the elastomer comprises PP (polypropylene).

4. The portable golf ball retaining plate of claim 1, wherein one of grooves has a greater width at the upper side thereof than that at a lower side thereof.

5. The portable golf ball retaining plate of claim 1, wherein one of the grooves has an opening formed in the upper side thereof and an opening formed in a lower side thereof.

6. The portable golf ball retaining plate of claim 1, wherein the adjusting portions comprise a bump.

7. The portable golf ball retaining plate of claim 1, wherein a connecting portion is arranged between two adjacent grooves.

* * * * *